US010145237B2

(12) United States Patent
Jahangir et al.

(10) Patent No.: US 10,145,237 B2
(45) Date of Patent: Dec. 4, 2018

(54) APPARATUS AND METHOD FOR EVALUATING A WELLBORE, IN PARTICULAR A CASING THEREOF

(75) Inventors: Mohammad Jahangir, Sandnes (NO); Tore Weltzin, Stavanger (NO)

(73) Assignee: STATOIL PERTOLEUM AS, Stavanger (NO)

( * ) Notice: Subject to any disclaimer, the term of this patent is extended or adjusted under 35 U.S.C. 154(b) by 909 days.

(21) Appl. No.: 13/260,010

(22) PCT Filed: Apr. 2, 2009

(86) PCT No.: PCT/EP2009/002424

§ 371 (c)(1),
(2), (4) Date: Dec. 9, 2011

(87) PCT Pub. No.: WO2010/112042

PCT Pub. Date: Oct. 7, 2010

(65) Prior Publication Data

US 2012/0080184 A1 Apr. 5, 2012

(51) Int. Cl.
*E21B 47/12* (2012.01)
*E21B 47/00* (2012.01)

(52) U.S. Cl.
CPC ..... *E21B 47/124* (2013.01); *E21B 47/0005* (2013.01)

(58) Field of Classification Search
CPC ..... E21B 47/124; E21B 47/0005
USPC ..... 175/40, 50, 57; 73/152.45, 152.54, 73/152.57; 166/253.1, 250.14, 254.2, 166/250.05, 250.08, 66, 241.1, 241.2
See application file for complete search history.

(56) References Cited

U.S. PATENT DOCUMENTS 5,153,832 A 10/1992 Anderson et al.
5,160,925 A * 11/1992 Dailey et al. ..... 340/853.3
5,358,039 A * 10/1994 Fordham ..... 166/241.1
5,589,825 A * 12/1996 Pomerleau ..... 340/854.9
5,644,186 A * 7/1997 Birchak et al. ..... 310/337
(Continued)

FOREIGN PATENT DOCUMENTS

GB 2 323 109 A 9/1998
WO WO 2005/071225 A1 8/2005
(Continued)

*Primary Examiner* — George S Gray
(74) *Attorney, Agent, or Firm* — Birch, Stewart, Kolasch & Birch, LLP

(57) ABSTRACT

The apparatus for evaluating a wellbore while drilling includes a logging toolheld on a drill string and is adapted to obtain data from the wellbore while moving the drill string including the logging tool uphole and out of the wellbore. The logging tool includes a memory for storing obtained data and an on-board power supply battery. A computer being positioned at a surface level of the wellbore is adapted to obtain the data from the memory when the logging tool is also positioned at the surface level. The logging tool is adapted to perform a minimum power-consuming sleep mode with a data obtaining and storing function being disabled and the computer is adapted to transmit a wake-up signal downhole to enable the data obtaining and storing function of the logging tool just prior to tripping out the drill string from the wellbore. The wake-up signal preferably is a mud pulse signal sent through the drilling fluid used when drilling the wellbore.

14 Claims, 3 Drawing Sheets

(56) References Cited

U.S. PATENT DOCUMENTS

Figure 1A:
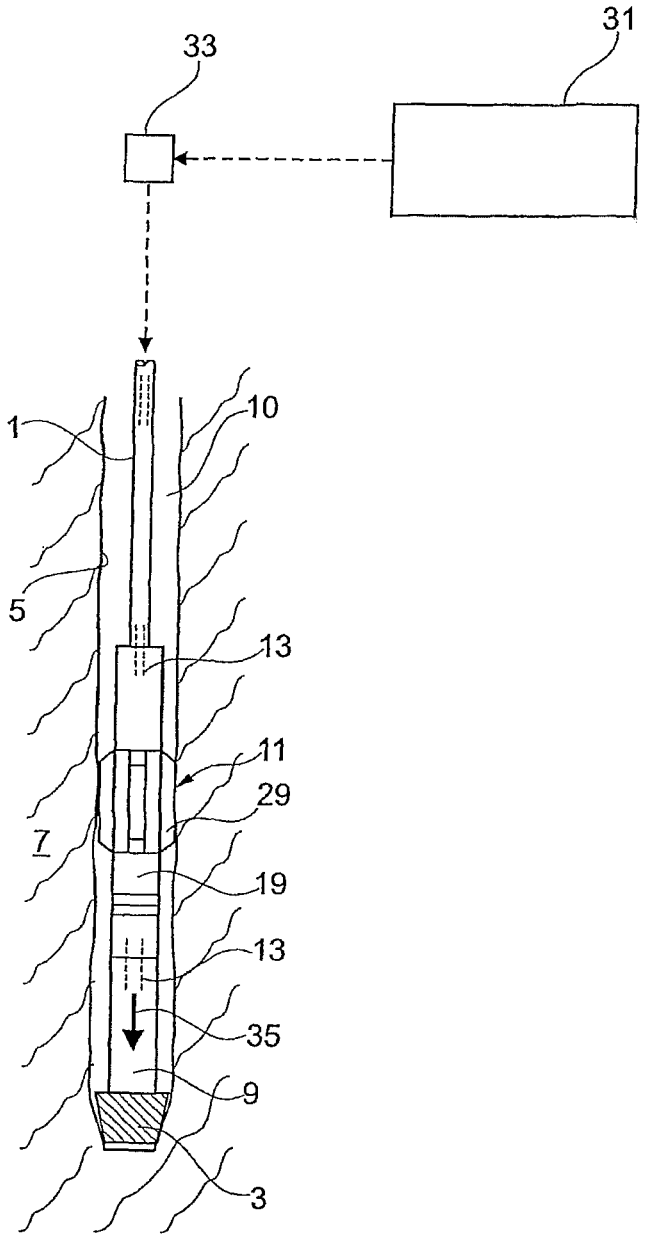

| | | | | |
|---|---|---|---|---|
| 5,960,883 | A * | 10/1999 | Tubel et al. | 166/313 |
| 6,041,860 | A | 3/2000 | Nazzal et al. | |
| 6,831,571 | B2 * | 12/2004 | Bartel | 340/854.6 |
| 6,928,864 | B1 | 8/2005 | Henry et al. | |
| 7,275,597 | B2 | 10/2007 | Hall et al. | |
| 7,634,942 | B2 * | 12/2009 | Green et al. | 73/152.57 |
| 8,011,447 | B2 * | 9/2011 | Keniston et al. | 175/45 |
| 2005/0016769 | A1 * | 1/2005 | Wallace | E21B 17/028 175/40 |
| 2011/0290011 | A1 * | 12/2011 | Dowla | E21B 17/08 73/152.16 |

FOREIGN PATENT DOCUMENTS

| | | | | |
|---|---|---|---|---|
| WO | WO 2008/047107 | A1 | 4/2008 | |
| WO | WO 2008094050 | A2 * | 8/2008 | G01N 29/34 |

* cited by examiner

APPARATUS AND METHOD FOR EVALUATING A WELLBORE, IN PARTICULAR A CASING THEREOF

The invention relates to an apparatus and a method for evaluating a wellbore while drilling, and in particular for evaluating a casing and/or cement in an annulus behind the casing of the wellbore.

When drilling a wellbore (bore hole) in the field of oil or natural gas production, it is important for the success of the drilling process to have information of the conditions related to the wellbore. In particular, information about the condition of the casing and the bonding of the casing to the cement in the annulus behind it is most valuable, since these parameters effect the further construction of the well. Wear on the casing is important to know for integrity reasons as a burst casing can be costly and potentially may lead to a dangerous well control situation.

It is commonly known, for example from U.S. Pat. No. 6,041,860, to inspect the wellbore through a wireline logging system comprising a logging or sensing tool which is lowered at the end of a cable into the wellbore. The logging tool is connected through a wireline telemetering system to a computer on the surface level of the wellbore for analyzing the data continuously supplied by the sensing tool to the computer. Before the logging tool can be run into the wellbore, the drilling process must be suspended and the drill string has to be removed, e.g. tripped out. For example, a separate wireline logging run for inspection of the casing takes about 4 to 6 hours and has to be carried out in approximately 50-70% of the wellbores.

Wireline logging creates problems in case of directional drilling, since the gravity propelled logging tool may get stuck in the wellbore. In order to avoid this problem, it is known from U.S. Pat. No. 5,589,825 to provide a drill pipe string adjacent to its downhole drill bit or its bottom hole assembly with a drilling sub being capable of receiving a logging tool through the drill pipe string after having suspended the drilling process. The logging tool is sent down to the drilling sub from a surface level position at the drilling platform prior to commencing tripping out the drill pipe string. While moving the drill pipe string uphole, sensors of the logging tool provide data which are stored in a memory of the logging tool. The position of the logging tool with respect to the wellbore is sensed by the computer on the surface level. After the drilling sub has tripped out of the wellbore, the logging tool is recovered from the drilling sub and is connected to the computer for communicating the data stored in the memory to the computer for evaluating the data versus depths or tripping out time.

Since the logging tool known from U.S. Pat. No. 5,589,825 is run downhole through the drill pipe string, the uphole end of the drill pipe string has to be cleared for inserting the logging tool by disconnecting the circulating head of the drilling rig to open the upper end of the drill pipe string, and in case of directional drilling, the logging tool may also get stuck in the drill pipe string.

From U.S. Pat. No. 7,275,597 B2, it is known to take record measurements at a plurality of selected points along a downhole tool string. The equipment installed in the tool string comprises a plurality of electronic devices, each being separately powered by a battery. The electronic devices relay their data to a surface level computer via a two-way telemetry system, through which individual power state switching instructions are also transmitted from the surface level computer to the downhole electronic devices. The system known from U.S. Pat. No. 7,275,597 B2 needs a complicated transmission system.

It is an object of the invention to provide an apparatus and a method for evaluating a wellbore in a less time consuming manner and with less constructional expense than hitherto.

According to the invention, the apparatus for evaluating a wellbore while drilling comprises:

a drill string including a downhole drilling tool;

a logging tool configured to evaluate either or both of a casing and cement in an annulus behind the casing along the wellbore, the logging tool being held on the drill string at a downhole position thereof, wherein the logging tool is configured to obtain data from the wellbore while moving the drill string including the logging tool uphole and out of the wellbore, and wherein the logging tool includes a memory for storing obtained data and an on-board power supply battery; and a computer positioned at a surface level of the wellbore and configured to obtain the data from the memory when the logging tool is also positioned at the surface level;

wherein the logging tool is configured to perform a minimum power consuming sleep mode with a data obtaining and storing function being disabled and the computer is configured to transmit a wake-up signal downhole to enable the data obtaining and storing function of the logging tool.

Contrary to the logging system known from U.S. Pat. No. 5,589,825 the logging tool is mounted to the drill string prior to the start of moving the drill string downhole and the start of the drilling operation. During drilling, the logging tool is run downhole with the data obtaining and storing function remaining in a deactivated state and the logging tool remaining in its sleep mode, in which the power consumption of electronic components of the logging tool is at a marginal minimum thus only negligibly discharging the battery. The battery has a capacity sufficient to withstand also longer drilling periods. Since contrary to the logging tool system known from U.S. Pat. No. 5,589,825, the uphole end of the drill string does not need to be accessible for inserting the logging tool so that a coiled drill pipe string associated with a bottom hole assembly drilling tool can be used in a preferred embodiment of the invention.

If the drilling operation is stopped for tripping out the drill string, the surface level computer transmits a wake-up signal downhole to the logging tool immediately before the drill string including the logging tool starts to be moved out of the wellbore. The surface level computer controls or measures the position of the drill string relatively to a reference point of the wellbore to provide for a time dependency or a distance dependency of the data obtained and stored by the logging tool during tripping out of the wellbore.

Depending on the parameters to be measured, the logging tool can comprise individual measuring devices including at least an acoustic device or an ultrasonic device or an infrared device or a radio-frequency device, but also a tactile device like a calliper or a camera for optical viewing may be included. Preferably the measuring device provides data not only continuously along the wellbore but also azimuthally around the wall of the wellbore in a 360° manner, such that with a single trip of the logging tool the complete surface of the wellbore can be scanned.

Logging tools for casing inspection capable of recording the thickness and integrity of the casing and the extent of corrosion the casing has undergone are known. So it is known to evaluate the casing thickness and other parameters by means of acoustic, electrical or mechanical techniques. Logging tools providing a representation of the integrity of the cement, in particular whether the cement adheres solidly to the outside of the casing, are also known. Typically, these tools are of a sonic type. Magnetic resonance logging tools also may be used for evaluating the casing and the cement. These technologies use a sequence of pulses which are sent out from a transmitter/receiver unit while the reflected wave is recorded.

In a preferred embodiment, the logging tool comprises a centralizer for guiding the logging tool coaxial with the wellbore to improve the measuring accuracy.

The wake-up signal sent by the surface level computer to activate the logging tool immediately prior to the tripping out operation is a simple pulse signal comprising at least one pulse, preferably a predetermined series of pulses, which are sent by means of a mud pulse system via the drilling fluid (mud) used during the drilling operation. Additionally or alternatively, an acoustical or electrical pulse signal may be transmitted via the metal pipes of the drill string. Also the acoustical or electrical may consist of a single pulse or preferably of a predetermined sequence of pulses. The logging tool comprises a receiver which is responsive to the pulse signal and activates the data obtaining and storing function in response to the detection of the pulse signal defining the wake-up signal.

The logging tool preferably is mounted to the drill string adjacent the drilling tool, and further preferably is in the form of a drill pipe section detachably mounted to the drill string. The logging tool has a through channel guiding the flow of drilling fluid to the drilling tool.

In a preferred embodiment, the logging tool is a modular unit comprising at least a sensing module and a battery module. The memory preferably is part of the battery module such that the battery module including the memory may be detached from the logging tool for transmitting the data stored in the memory to the surface level computer.

The invention further relates to a method for evaluating a casing and/or cement in an annulus behind the casing along a wellbore while drilling, comprising the steps of:

- mounting a logging tool to a drill string having a drilling tool, wherein the logging tool has a function to obtain and store data sensed within the wellbore,
- commanding the logging tool into a minimum power-consuming sleep mode to disable the data obtaining and storing function,
- moving the drill string including the logging tool in its sleep mode downhole while drilling the wellbore,
- stopping drilling the wellbore and transmitting a wake-up signal downhole to the logging tool from a computer positioned at a surface level of the wellbore to enable the data obtaining and storing function of the logging tool,
- tripping the drill string including the enabled logging tool out of the wellbore while the logging tool is obtaining and storing data sensed within the wellbore, and
- transmitting the data stored in the logging tool to the computer after the logging tool has reached the surface level of the wellbore.

Preferably, the method is carried out by means of an apparatus according to the invention as explained above.

In the following the invention will be described with reference to the accompanying drawing which shows a preferred embodiment an apparatus for evaluating a casing of a wellbore and/or cement in an annulus behind the casing.

Figure 1B:
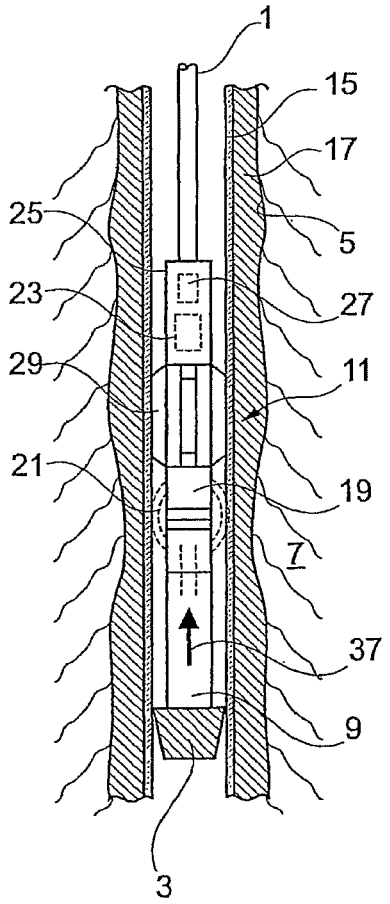
Figure 1C:
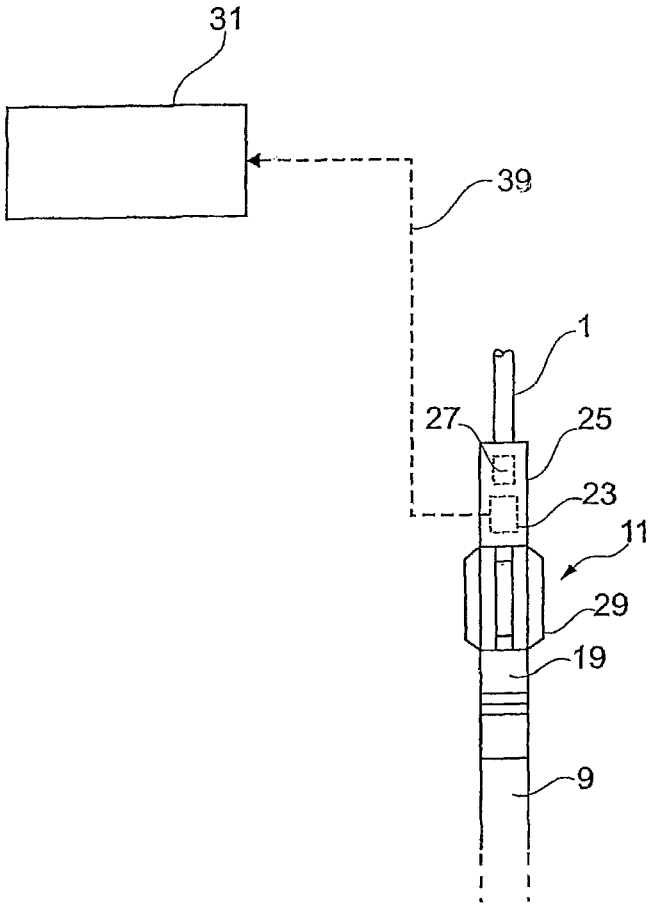

FIG. 1*a* shows a section through a wellbore with the apparatus drilling the wellbore;

FIG. 1*b* shows the apparatus during a tripping out operation in a cased section of the wellbore; and FIG. 1*c* shows the apparatus above the surface level of the wellbore.

FIG. 1*a* shows a drill pipe string 1 with a drilling tool 3 at its downhole end while drilling a wellbore 5 into a formation 7. The drill pipe string 1 may consist of a plurality of tubular pieces, but also may be in the form of a coiled tubing. The drilling tool 3 can be in the form of a drill bit, but the drill bit preferably is associated to a bottom hole assembly 9 to provide for rotational driving and/or directional drilling. Drilling fluid or mud is circulated downhole to the drilling tool 3 through the drill pipe string 1 and uphole through an annulus 10 between the drill pipe string 1 and the wellbore 5. Adjacent the bottom hole assembly 9, a logging tool 11 is attached to the drill pipe string 1. The logging tool 11 forms a unit which mechanically connects the bottom hole assembly 9 to the drill pipe string 1 and has a through channel 13 guiding the drilling fluid from the drill pipe string 1 to the drilling tool 3.

As best can be seen from FIG. 1*b*, the logging tool 11 is adapted to evaluate a tubular casing 15 which is cemented by cement 17 provided in the annulus behind the casing 15 to the wellbore 5. Additionally or alternatively, the logging tool 11 may be adapted to evaluate the bonding of the cement 17 to the casing 15. To sense corrosion or other defects of the casing 15 or the integrity of the cement 17, the logging tool 11 comprises a sensor unit 19 capable of evaluating physical properties of the casing 15 and the cement 17. For example, the sensor unit 19 determines the thickness and integrity of the casing 15 and the extent of corrosion. Further, it evaluates whether the cement 17 adheres solidly to the outside of the casing 15, or contains hollow portions. As explained below, the sensor unit 19 measures the physical parameters continuously along the wellbore 5 while the logging tool 11 is moving out of the wellbore 5. Further, the sensor unit 19 senses the physical parameters continuously azimuthally, e.g. around 360° and thus scans the whole body of the casing 15 and/or the cement 17.

In the preferred embodiment shown in the drawing, the sensor unit 19 comprises a transmitter/receiver which periodically transmits a pulse signal as indicated at 21 in FIG. 1*b* of a supersonic wave or an electro-magnetic wave, which is reflected by the casing 15 and/or the cement 17. The reflected wave is received by the transmitter/receiver of the sensor unit 19 and is stored in a memory 23 of a communication unit 25 of the logging tool 11. The communication unit 25 is an electronic device and includes a battery 27 as a power supply for the communication unit 25 and the sensor unit 19.

To improve the measuring accuracy of the sensor unit 19, the logging tool 11 is provided with a centralizer 29 which guides the logging tool 11 coaxially with respect to the casing 15.

The communication unit 25 including the memory 23 as well as the sensor unit 19 are capable of being operated in a sleep mode, in which the power consumption of the electronic components is at a marginal minimum, and in which the data sensing and storing function of the sensor unit 19 and the memory 23 is disabled, i.e. deactivated. The communication unit 25 is adapted to receive a wake-up signal generated by a mud pulse generator 33 in response to a command of the computer 31. The mud pulse signal is transmitted through drilling fluid fed through the drill pipe string 1 to the drilling tool 3. The wake-up signal comprises at least one pulse, preferably a predetermined sequence of pulses which is recognized by the communication unit 25 to activate or switch on the sensing and storing function of the logging tool 11.

Before commencing the drilling operation, the computer 31 switches the logging tool 11 into the sleep mode, and thereafter the wellbore 5 is drilled down to a desired depth (arrow 35). After having stopped drilling and just before starting to pull out the drill pipe string 1 from the wellbore 5, the computer 31 commands the mud pulse generator 33 to transmit the wake-up signal to the communication unit 25 to activate the sensing and storing function of the logging tool 11. While the drill pipe string 1 and the logging tool 11 are continuously moved out of the wellbore 5 (arrow 37 in FIG. 1*b*), the memory 23 stores data continuously provided by the sensor unit 19. The computer 31 measures the position of the logging tool 11 with respect to a reference point of the wellbore 5 through measuring the position of the drill pipe string 1 or the elapsed time interval since the start of the tripping out movement to provide for a continuous log of the physical parameters of the casing 15 and/or the cement 17. It is to be noted that no data are transmitted to the computer 31 from the communication unit 25 during the tripping operation. After the logging tool 11 has reached the surface level of the computer 31, a communication link 39, e.g. in the form of a cable, is established between the communication unit 25 and the computer 31 to read out stored data from the memory 23. The computer 31 evaluates the casing 15 and the cement 17 depending on the data thus obtained.

In the embodiment explained above, the wake-up signal is transmitted in the form of a mud pulse signal. Alternatively or additionally, an acoustical or electrical wake-up signal can be transmitted through the metal body of the drill pipe string 1.

The logging tool 11 is a modular construction, which comprises at least a sensing module and a battery module to allow replacement for example of the sensor unit 19 by another type of sensing unit, for example a calliper-type sensing unit. The battery module allows quick replacement of a discharged battery. Additionally the communication unit 25 including the memory 23 also forms a module to which the battery module may be attached. The logging tool 11 per se is detachably mounted to the drill pipe string 1.

The invention claimed is:

1. An apparatus for evaluating a wellbore while drilling, the apparatus comprising:

a drill string including a downhole drilling tool;

a logging tool configured to evaluate either or both of a casing and cement in an annulus behind the casing along the wellbore, the logging tool being directly attached to a drill pipe and above a bottom hole assembly while circulating a drilling fluid through the drilling tool, wherein the logging tool is configured to obtain data from the wellbore while moving the drill string including the logging tool uphole and out of the wellbore and wherein the logging tool includes a memory for storing obtained data and an on-board power supply battery; and a computer positioned at a surface level of the wellbore and configured to obtain the data from the memory when the logging tool also is positioned at the surface level, wherein the logging tool is configured to perform a sleep mode which reduces power consumption by disabling a data obtaining and storing function and the computer is configured to transmit a wake-up signal downhole to enable the data obtaining and storing function of the logging tool, wherein the logging tool has a through channel directly connected to the drill pipe to guide the drilling fluid from the drill pipe through the through channel of the logging tool to the drilling tool, and wherein the logging tool mechanically connects the drill pipe to the bottom hole assembly.

2. The apparatus according to claim 1, wherein the logging tool comprises a centralizer for guiding the logging tool coaxial with the wellbore.

3. The apparatus according to claim 2, wherein the wake-up signal is a mud pulse signal transmitted via drilling fluid and/or an acoustical or electrical pulse signal transmitted via the drill string.

4. The apparatus according to claim 2, wherein the logging tool is mounted to the drill string adjacent the drilling tool.

5. The apparatus according to claim 2, wherein the logging tool is in the form of a drill pipe section detachably mounted to the drill string and having a through channel for the drilling fluid.

6. The apparatus according to claim 1, wherein the wake-up signal is a mud pulse signal transmitted via drilling fluid or an acoustical or electrical pulse signal transmitted via the drill string.

7. The apparatus according to claim 6, wherein the logging tool is mounted to the drill string adjacent the drilling tool.

8. The apparatus according to claim 6, wherein the logging tool is in the form of a drill pipe section detachably mounted to the drill string and having a through channel for the drilling fluid.

9. The apparatus according to claim 1, wherein the logging tool is mounted to the drill string adjacent the drilling tool.

10. The apparatus according to claim 1, wherein the logging tool is in the form of a drill pipe section detachably mounted to the drill string and having a through channel for the drilling fluid.

11. The apparatus according to claim 1, wherein the logging tool is a modular unit comprising at least a sensing module and a battery module.

12. A method for evaluating either or both of a casing and cement in an annulus behind the casing along a wellbore while drilling, comprising the steps of:

directly mounting a logging tool to a drill string having a drilling tool, wherein the logging tool is directly attached to a drill pipe and above a bottom hole assembly while circulating a drilling fluid through the drilling tool, and the logging tool has a function to obtain and store data sensed within the wellbore;

commanding the logging tool into a sleep mode which reduces power consumption by disabling the data obtaining and storing function, moving the drill string including the logging tool in the sleep mode downhole while drilling the wellbore, stopping drilling and transmitting a wake-up signal downhole to the logging tool from a computer positioned at a surface level of the wellbore to enable the data obtaining and storing function of the logging tool, tripping the drill string including the enabled logging tool out of the wellbore while the logging tool is obtaining and storing data sensed within the wellbore, and transmitting the data stored in the logging tool to the computer after the logging tool has reached the surface level of the wellbore, wherein the logging tool is directly attached to the drill pipe by directly connecting a through channel of the logging tool to the drill pipe to guide the drilling fluid from the drill pipe through the through channel of the logging tool to the drilling tool, and wherein the logging tool mechanically connects the drill pipe to the bottom hole assembly.

13. The method according to claim 12, wherein the step of tripping out the drill string from the wellbore includes the step of centralizing the logging tool coaxially to the wellbore.

14. The method according to any claim 12, wherein the step of transmitting the wake-up signal includes the step of transmitting a mud pulse signal via drilling fluid or an acoustical or electrical pulse signal via the drill string.

* * * * *